US011673008B1

(12) United States Patent
Pipe et al.

(10) Patent No.: US 11,673,008 B1
(45) Date of Patent: Jun. 13, 2023

(54) FIRE PROTECTION SYSTEMS AND METHODS FOR THE PROTECTION OF SLOPED ATTIC SPACES HAVING A SPAN OF UP TO 100 FT

(71) Applicant: Minimax Viking Research & Development GmbH, Bad Oldesloe (DE)

(72) Inventors: Jed Edmond Pipe, Byron Center, MI (US); Shawn Gregory Orr, Grand Rapids, MI (US)

(73) Assignee: Minimax Viking Research & Development GmbH, Bad Oldesloe (DE)

( * ) Notice: Subject to any disclaimer, the term of this patent is extended or adjusted under 35 U.S.C. 154(b) by 0 days.

(21) Appl. No.: 16/720,868

(22) Filed: Dec. 19, 2019

Related U.S. Application Data

(60) Provisional application No. 62/781,685, filed on Dec. 19, 2018.

(51) Int. Cl.
*A62C 35/60* (2006.01)
*A62C 35/68* (2006.01)

(52) U.S. Cl.
CPC ..... *A62C 35/60* (2013.01); *A62C 35/68* (2013.01)

(58) Field of Classification Search
CPC ..... A62C 35/60; A62C 35/68; A62C 37/40; A62C 3/00; A62C 99/0009; A62C 35/00; A62C 35/58; A62C 35/62; A62C 35/64; A62C 35/605; A62C 37/00; Y10S 239/15
USPC ..... 169/16, 19
See application file for complete search history.

(56) References Cited

U.S. PATENT DOCUMENTS

| | | | | |
|---|---|---|---|---|
| 3,081,041 | A | 3/1963 | Showalter, Jr. | |
| 3,881,653 | A | 5/1975 | Birckhead | |
| 5,669,449 | A | 9/1997 | Polan et al. | |
| 8,083,002 | B1 | 12/2011 | Golinveaux et al. | |
| 8,733,461 | B2 | 5/2014 | Pigeon | |
| 8,800,673 | B2 * | 8/2014 | Multer | A62C 37/11 169/16 |
| 9,149,818 | B1 | 10/2015 | Orr | |
| 9,278,239 | B2 | 3/2016 | Pigeon | |
| 9,381,386 | B2 | 7/2016 | Pigeon | |
| 9,675,827 | B2 | 6/2017 | Pigeon | |

(Continued)

FOREIGN PATENT DOCUMENTS

WO WO2019/160740 8/2019

OTHER PUBLICATIONS

Globe Fire Sprinkler Corporation, GFS-650: "Specific Application Attic Sprinklers" (Jul. 2018); 2 pages.
Reliable Automatic Sprinkler Co., Inc. Models DD56-6, DD56-27, DD80-6, DD80-27, DS56, GP56, AH42, & AH56 . . . Bulletin 056, Sep. 2018; 26 pages.
The Viking Corporation, Form No. F-043015: "Model V-SD Specific Application Attic Sprinkler" (Feb. 19, 2016 Rev. 16.1); 12 pages.

(Continued)

*Primary Examiner* — Qingzhang Zhou
*Assistant Examiner* — Joel Zhou
(74) *Attorney, Agent, or Firm* — Perkins Coie LLP

(57) ABSTRACT

Attic fire protection systems and methods for the protection of sloped attic spaces having large roof spans over eighty feet up to one hundred feet (80-100 ft.). The systems and method provide for a five-branch system with sprinklers having a directional spray interleaved between sprinklers having a uniform radial spray at the peak ridge and sprinklers having a uniform radial spray at the eave of the attic space. The systems and methods define a hydraulic demand with a total flow rate of under 175 GPM.

28 Claims, 4 Drawing Sheets

(56) References Cited

U.S. PATENT DOCUMENTS

| | | | |
|---|---|---|---|
| 10,149,992 | B2 | 12/2018 | Pigeon |
| 10,493,308 | B2 | 12/2019 | Pigeon |
| 10,940,350 | B2 | 3/2021 | Pigeon |
| 11,027,160 | B2 | 6/2021 | Pigeon |
| 2014/0083722 | A1 | 3/2014 | Pigeon |
| 2015/0265865 | A1 | 9/2015 | Pigeon |
| 2017/0165511 | A1 | 6/2017 | Meyer et al. |
| 2019/0099630 | A1 | 4/2019 | Pigeon |
| 2019/0329080 | A1 | 10/2019 | Pigeon |
| 2020/0368567 | A1 | 11/2020 | Pigeon |
| 2021/0353988 | A1 | 11/2021 | Desrosier |

OTHER PUBLICATIONS

The Viking Corporation, Form No. F-042517: Attic Upright Specific Application Sprinkler VK697, Aug. 23, 2018 Rev 18.2, 8 pages.

The Viking Corporation, Form No. F-042815: Attic Upright Specific Application Sprinkler VK696, Oct. 11, 2018 Rev 18.2.p. 65, 7 pages.

Wilkins, Roger, Application: The Use of Specific Application Sprinklers for Protecting Attic, Tyco Fire & Building Products, 92 pages, Dec. 2007.

Tyco Fire Products, Technical Datasheet, "Models BB, SD, HIP, and AP Specific Application Sprinklers for Protecting Attics", TFP610, Aug. 2018, 28 pages.

* cited by examiner

FIRE PROTECTION SYSTEMS AND METHODS FOR THE PROTECTION OF SLOPED ATTIC SPACES HAVING A SPAN OF UP TO 100 FT

PRIORITY CLAIM & INCORPORATION BY REFERENCE

This application claims the benefit of U.S. Provisional Application No. 62/781,685 filed Dec. 19, 2018, which is incorporated by reference in its entirety.

TECHNICAL FIELD

The present invention relates generally to fire protection sprinklers, systems and methods for the protection of attic spaces. In particular, the present invention is directed to fire protection sprinklers, systems and methods for the protection of combustible and non-combustible sloped attic spaces.

BACKGROUND ART

The design and installation of automatic fire sprinkler protection systems is dependent upon several factors including: the area to be protected, the occupants or items to be protected in the area being protected, the manner in which a fire is to be addressed. One particular area of interest is automatic fire protection systems for attic spaces beneath sloped roofs. Generally, a sloped attic space includes a floor in the form of a horizontal ceiling deck with two sloped roof decks supported above the ceiling deck to enclose the attic space. The roof decks are angled with respect to one another to form a ridgeline or peak of the attic space. Each of the roof decks slope down from the peak toward the ceiling deck to define the slope down direction and form eave regions with the lateral ends of the ceiling deck. In a gable roof construction, for example, the attic space, when viewed in elevation, is triangular with the peak forming the upper vertex and the eave region forming the other two vertices of the triangle proximate the ceiling deck. In plan, the length of the peak ridge line defines the axial length of the sloped attic space and the distance from eave to eave along the ceiling deck perpendicular to the ridge line defines the span of the attic space.

Attic fire protection systems locate one or more automatic fire protection sprinklers about the attic space for delivering and distributing firefighting fluid in response to a fire or sufficient level of heat. Generally, automatic fire protection sprinklers include a solid metal body and some type of deflector to distribute fluid discharged from the body in a defined spray distribution pattern. Fluid discharge from an automatic fire protection sprinkler is automatically controlled by operation of a heat-responsive actuator that maintains a fluid tight seal at the discharge orifice by exertion of pressure on a cap (button or disc) or other sealing assembly. When the temperature surrounding the sprinkler is elevated to a pre-selected value indicative of a fire, the actuator operates thereby permitting ejection and release of the cap by the discharge of fluid through the unsealed sprinkler.

Automatic sprinklers can be characterized by: its discharge characteristics, its installation orientation (pendent or upright), and its fluid distribution and coverage. Several factors can influence the fluid distribution patterns of a sprinkler and its coverage including, for example, the shape of the sprinkler frame, the sprinkler orifice size or discharge coefficient, the installation orientation and the geometry of the deflector. The discharge or flow characteristics from the sprinkler body is defined by the internal geometry of the sprinkler including its internal passageway, inlet and outlet (the orifice). As is known in the art, the K-factor of a sprinkler is defined as $K=Q/(P)^{1/2}$, where Q is fluid flow rate from the sprinkler for a given fluid starting pressure P, each of which is measured in appropriate metric or English units. For example, Q represents the flow rate (in gallons/min GPM) and P represents the pressure (in pounds per square inch (psi.)) of water or firefighting fluid fed into the inlet end of the internal passageway though the sprinkler body.

Examples of known attic sprinkler configurations are shown and described in U.S. Pat. Nos. 9,149,818; 8,083,002; and 5,669,449. The sprinklers show a variety of deflector geometries for distributing for firefighting fluid within an attic space. For example, U.S. Pat. No. 9,149,818 shows and describes an upright sprinkler with a fluid deflector having a central deflecting portion, sidewalls and two angled flaps opposed about the central deflector for redirecting a divided fluid stream in opposed downward angled directions. U.S. Pat. No. 8,083,002 shows and describes an upright sprinkler with a circular fluid deflector for distributing firefighting fluid in a substantially circular cylindrical or radially uniform spray pattern about the sprinkler body. U.S. Pat. No. 5,669,449 shows and describes other attic sprinklers including an upright sprinkler with a deflector geometry for distributing firefighting fluid in a unidirectional or single direction. The fluid deflector includes a central deflecting portion with sidewalls to direct firefighting fluid in the designed single direction. In the directional fluid deflectors, the central deflecting portions are shown with a constant width about which the sidewalls extend.

In attic fire protection systems, automatic sprinklers are coupled to one or more fluid supplying branch lines that extend through the attic space. The number of sprinklers, their relative spacing and location within the attic space is dependent on several design factors including the fluid supply criteria or hydraulic demand to deliver a requisite flow rate or supply pressure of fluid to a number of design sprinklers or a requisite fluid density of fire fluid, i.e., flow per area measured in (gallons per minute (GPM) per square foot (sq. ft.)) to a design area of a specified size. Industry accepted installation standards generally require a delivered fluid density of 0.1 GPM/sq. ft over a design area to be protected. Alternatively, systems can demonstrate the requisite fluid distribution capability by using automatic sprinklers that have satisfactorily performed in full-scale actual fire test in which the automatic sprinkler delivered a constant flow of firefighting fluid when supplied with the fluid at a constant pressure.

The design sprinklers of a system are an identified number of "most hydraulically remote sprinklers"; "most hydraulically demanding sprinklers"; or "most demanding sprinklers" subject to one or more design criteria. As used herein, the "most hydraulically remote sprinklers"; "most hydraulically demanding sprinklers"; or "most demanding sprinklers" are those sprinklers that experience the greatest fluid pressure loss relative to the fluid supply source when supplying the sprinklers with the minimum fluid flowing operating pressure for the sprinkler. In satisfying the preferred hydraulic criteria of the system, it can be shown by hydraulic calculation that if all design sprinklers activate, the piping and supply can provide the required fluid flow. Alternatively, or additionally, the hydraulic criteria of the system can be shown by hydraulic calculation, that if all design sprinklers activate, the piping and supply can deliver a minimum operating pressure of firefighting fluid, 7 psi. of firefighting fluid, the design sprinklers provide for a minimum fluid density of 0.1 GPM/sq. ft. over a design area defined by either a number of design sprinklers defined by their respective coverage areas or the planar footprint of the sloped roof deck.

One known attic fire protection system from Viking Corp. provides protection of sloped roof attic spaces having a roof span up to a maximum of sixty feet (60 ft.) for roof slopes that range from 4 inch of vertical rise for 12 inches of horizontal run (4:12) to 12 inches of rise for 12 inches of run (12:12). The system is shown and described in technical data sheet publication "Form No. F-043015: "Model V-SD Specific Application Attic Sprinkler" (Feb. 19, 2016 Rev. 16.1) from The Viking Corp of Hastings, Mich. Generally, the Viking system provides one line of sprinklers aligned below and parallel the ridge line to provide a uniform radial spray pattern. Unidirectional type sprinklers are located between the roof peak and the eaves. These directional sprinklers direct their spray toward the eaves for the protection of this region of the attic.

Another known system from Globe Fire Sprinkler Corporation of Standish, Mich. provides for three branch lines to which sprinklers are connected for protection of sloped roof attic spaces having a roof span up to a maximum of seventy-two feet (72 ft.) for roof slopes that ranges from 3 inch of vertical rise for 12 inches of horizontal run (3:12) to 6 inch of rise for 12 inches of run (6:12). The system is shown and described in technical data sheet publication GFS-650: "Specific Application Attic Sprinklers" (July 2018) available at <haps://globesprinkler.com/uploads/files/GFS-650_20180730CM_745.pdf>. Generally, the Globe system provides one branch line of sprinklers aligned below and parallel the ridge line with each of the other two branch lines of sprinklers aligned downslope of and parallel the ridge line between the peak and the eaves. These downslope sprinklers direct their spray toward the eaves for the protection of this region of the attic. With its three-branch line system alone, the Globe system is limited to protection of a maximum roof span of seventy-two feet. Protection of larger roof spans in the Globe or other attic fire protection systems require the installation of more branch lines and sprinklers and/or sprinklers installed in close proximity to the eave regions.

Large roof spans of over seventy-two feet, e.g., up to one hundred feet, present a challenge for the design and/or installation of automatic fire protection systems for attic spaces. One particular challenge is presented by large roof span attic spaces with low slope roofs. Slope can be characterized as a ratio of the vertical rise to the horizontal run of the roof deck from the eave to the ridge peak. The smaller the roof slope, less clearance space is available between the roof deck and ceiling deck, particularly at the eaves, for installation of system piping and sprinklers. Moreover, the small clearance in the eave region can present a challenge for sprinkler performance by requiring sprinklers to provide a fluid distribution of sufficient throw to reach the eaves from the available sprinkler installation locations.

Large attic roof spans can also present a hydraulic design challenge. In particular, it can present a design challenge to minimize the total fluid flow requirement of the system given the number of sprinklers or piping requirements to cover the attic space. In order to provide sufficient sprinkler coverage for the large roof span attic space, the system may require a large number of sprinklers and/or branch lines. For example, a nine (9) branch systems using quick response standard spray upright sprinklers to cover an attic space having a 100 ft. span and a ridge length of 150 ft. can require a total of over one hundred sprinklers. In addition to requiring a large number of sprinklers, such a system can require hydraulic demand of over 190 gallons per minute (GPM) for a hydraulic design area of about two thousand square feet (2000 sq. ft.).

In a system using known attic sprinklers from Reliable Automatic Sprinkler Co. of Elmsford, N.Y., the system provides for a three-branch line system with sixty (60) sprinklers to cover an attic space having a 100 ft. span and a ridge length of 150 ft. The known Reliable attic sprinklers having two different spray patterns with thirty sprinklers of one type and thirty sprinklers of another. Despite having fewer sprinklers and fluid supply branch lines, as compared to the previously described nine-branch system, the Reliable system still has a hydraulic demand of over 190 GPM. The hydraulic demand of the Reliable system, when defined by a total of 7-9 design sprinklers, consisting of a combination each sprinkler type, the hydraulic demand ranges from 220 GPM to 300 GPM. Accordingly, there remains a need for fire protection systems for attic spaces having roof spans up to 100 ft. that can be practically installed and/or with a hydraulic demand lower than those under known fire protection systems.

DISCLOSURE OF INVENTION

Preferred sprinklers, systems and methods are provided for protection of sloped roof attic spaces with maximum roof spans preferably ranging from over eighty feet to one hundred feet (80-100 ft.). The preferred methods of attic fire protection for these large roof spans provide for systems with a hydraulic demand lower than those under prior known commercial systems. Preferred embodiments of the systems and methods include a preferred five-branch system that combines different spray patterns. More preferably, the systems and methods include a plurality of sprinklers of a first type in which each sprinkler provides a uniform spray pattern radially about the sprinkler. The sprinklers of the first type are installed on three parallel branch lines with one proximate the ridge and two respectively proximate the eave regions. The preferred systems and methods also include a plurality of sprinklers of a second type that provides a directional spray pattern in which a majority of the spray is directed substantially in a desired direction preferably from downslope toward the eave. The sprinklers of the second type are coupled to two branch lines and respectively interleaved between the three branch lines of sprinklers of the first type. Given the preferred variation in spray patterns and sprinkler locations of the preferred systems and methods in the protection of sloped attic spaces with large roof spans, a total system hydraulic demand is preferably less than 200 GPM and no more than 175 GPM.

A preferred embodiment of a fire protection system for a sloped attic space is provided. The attic space includes a pair of sloped roof decks defining a ridge in between with a ceiling base extending between and below the sloping roof decks to define a pair of eaves equally spaced about the ridge and a maximum roof span. The system preferably includes a plurality of sprinklers of a first type having a frame defining an inlet, an outlet with a passageway extending between the inlet and the outlet along a sprinkler axis and a deflector affixed to the sprinkler frame at a fixed distance from the outlet to generate a preferably uniform spray about the sprinkler axis. The plurality of sprinklers of the first type consists of a first group aligned below the ridge; a second group aligned in a row between the ridge and one of the eaves parallel to the ridge; and a third group aligned in a row between the ridge and the other eave parallel to the ridge. The second and third group of sprinklers of the first type are spaced apart from one another preferably equidistantly about the ridge. The system also includes a plurality of sprinklers of a second type different than the first type. Each sprinkler of the second type has a frame defining an inlet, an outlet with a passageway extending between the inlet and the outlet along a sprinkler axis and a deflector affixed to the sprinkler frame at a fixed distance from the outlet to generate a spray from the sprinkler with a majority of the spray directed in a defined direction with respect to the sprinkler axis of the second type. The plurality of sprinklers of the second type preferably consists of: a first group of sprinklers aligned in a row between the ridge and the first group of sprinklers of the first type parallel to the ridge; and a second group of sprinklers aligned in a row between the ridge and the third group of sprinklers of the first type parallel to the ridge. The first and second group of the sprinklers of the second type are spaced apart from one another preferably equidistantly about the ridge. The first and second sprinkler types each provide a fluid density sufficient to define a maximum roof span of protection of over eighty feet to no more than one hundred feet (100 ft.) with a hydraulic demand of the system being less than two hundred gallons per minute (<200 GPM).

A preferred method is provided for fire protection of a large roof span attic space defined by a ridge peak and eave regions disposed about the ridge peak. The preferred method includes obtaining a plurality of directional spray sprinklers; and providing the plurality of directional spray sprinklers for interleaved installation between a group of sprinklers located at the ridge peak having a radially uniform fluid distribution and a group of sprinklers located proximate the eave region to define a large roof span protection of over eight feet up to 100 ft. (80+ ft.-100 ft.).

Another preferred method is provided for fire protection for a sloped attic space defined by a pair of sloped roof decks defining a ridge in between with a ceiling base extending between and below the sloping roof decks to define a pair of eaves equally spaced about the ridge to define a maximum roof span of over eighty feet (80 ft.). The preferred method includes providing a plurality of sprinklers of a first type for alignment in a first row below the ridge, a second row proximate one eave and a third row proximate the other eave. Each sprinkler of the first type provides a uniform radial spray about the sprinkler with each sprinkler having a frame defining an inlet, an outlet with a passageway extending between the inlet and the outlet along a sprinkler axis, each sprinkler including a deflector affixed to the sprinkler body at a fixed distance from the outlet to generate a uniform spray about the sprinkler axis. The preferred method also includes providing a plurality of sprinklers of a second type different than the first type with the plurality of sprinklers of the second type consisting of a first group and a second group for spacing apart from one another equidistantly about the ridge. Each sprinkler of the second type including a frame defining an inlet, an outlet with a passageway extending between the inlet and the outlet along a sprinkler axis, each sprinkler including a deflector affixed to the sprinkler frame at a fixed distance from the outlet to generate a spray from the sprinkler a majority of which is directed in the downward slope direction away from the ridge and toward the eave. The deflector of the second type includes a base with a flap extending angularly from the base, the flap including a central canopy portion and a pair of sidewalls disposed about the central canopy portion. The canopy portion preferably includes a first end and a second terminal end with each of the sidewalls being angled to define a discharge channel that broadens in the direction from the first end to the second terminal end.

Another preferred system provided a preferred five-branch fire protection system for a sloped attic space defined by a pair of sloped roof decks defining a ridge in between with a ceiling base extending between and below the sloping roof decks to define a pair of eaves equally spaced about the ridge to define a maximum roof span over eighty feet to one hundred feet (80+ ft.-100 ft.). The preferred system includes a plurality of sprinklers of a first type to generate a radially uniform spray about the sprinkler. The plurality of sprinklers of the first type preferably consists of: a first group aligned proximate the ridge along a first branch line; a second group proximate one eave along a second branch line within ten feet upslope of the one eave; and a third group proximate the other eave along a third branch line within ten feet upslope of the other eave. A plurality of sprinklers of a second type different than the first type generate a radial directional spray. The plurality of sprinklers of the second type consists of: a first group of sprinklers of the second type along one branch line between the first and second branch line downslope fifteen feet (15 ft) of the first branch line; and a second group of sprinklers of the second type along one branch line between the first and third branch line downslope fifteen feet (15 ft) of the first branch line.

BRIEF DESCRIPTION OF DRAWINGS

The accompanying drawings, which are incorporated herein and constitute part of this specification, illustrate exemplary embodiments of the invention, and together, with the general description given above and the detailed description given below, serve to explain the features of the invention. It should be understood that the preferred embodiments are some examples of the invention as provided by the appended claims.

MODE(S) FOR CARRYING OUT THE INVENTION

Figure 1A:
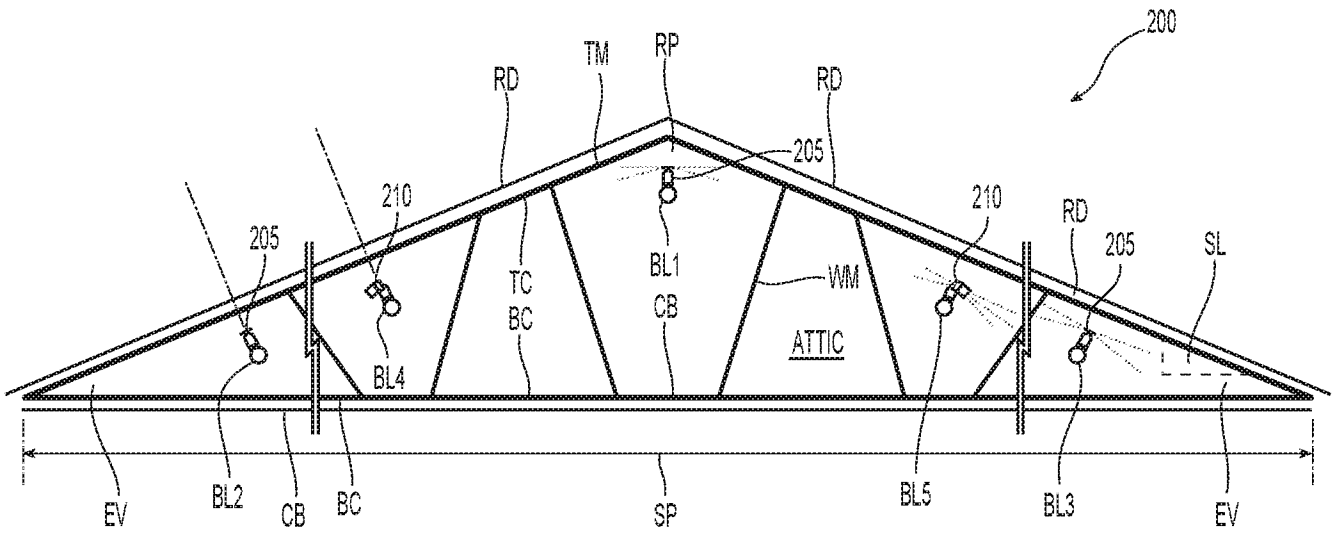
FIG. 1A is a schematic elevation view of a preferred automatic attic fire protection system.
Figure 1B:
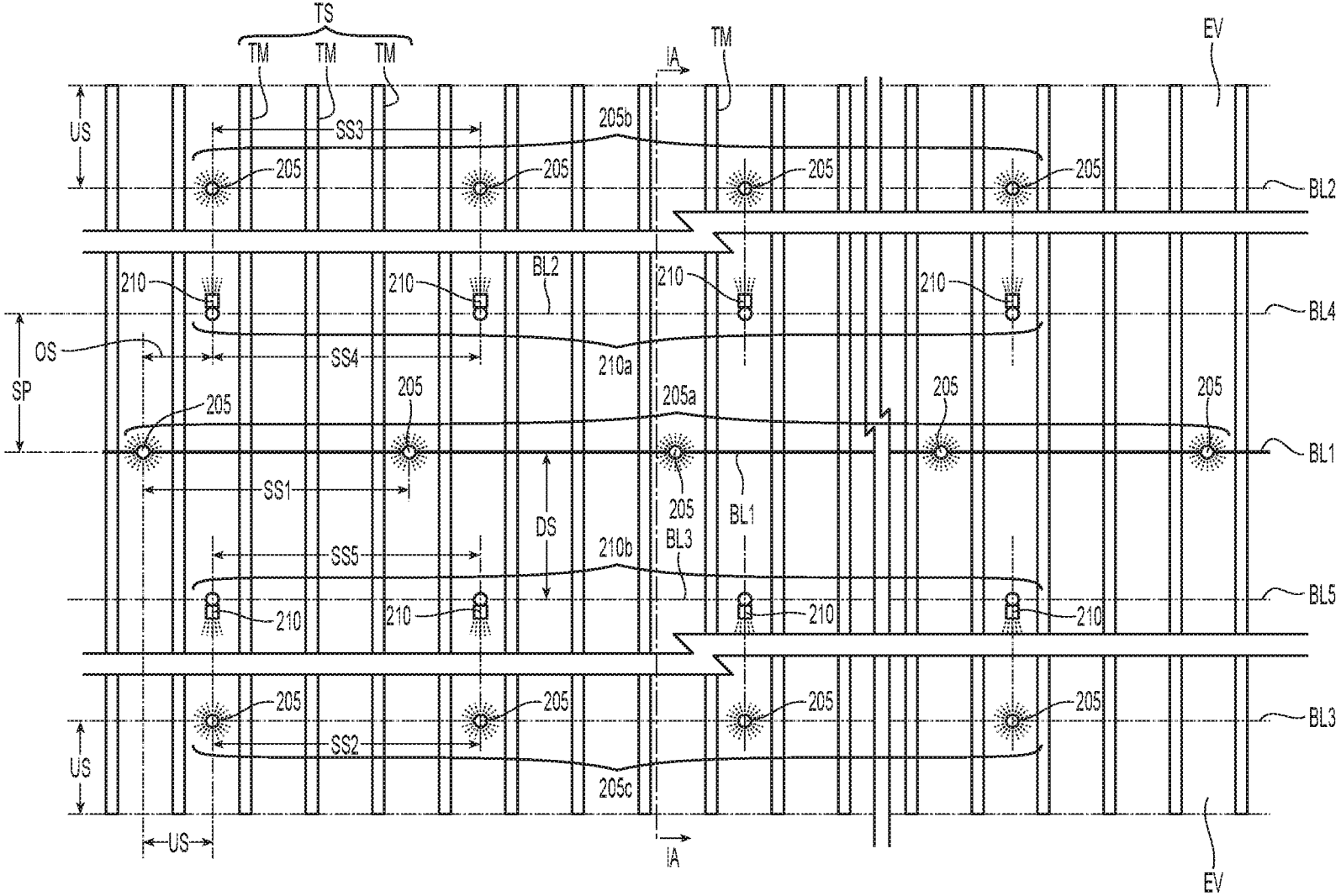
FIG. 1B is a plan view of the automatic fire protection system of FIG. 1A.

Shown in FIGS. 1A-1B are schematic views of a preferred attic fire protection system 200 installation for a sloped attic space ATTIC beneath a roof having a slope SL that ranges from 2½ inch of vertical rise for twelve inches of horizontal run (2½:12) to 12 inch of rise for 12 inches of run (12:12) and more preferably ranging from 2½:12 to 6:12. The sloped attic space ATTIC is formed between a ceiling base CB and a pair of sloped roof decks RD supported by a truss system TS defining a ridge peak RP in between with the ceiling base CB extending between and below the sloping roof decks to define a pair of eaves EV equally spaced about the ridge RP to define a preferred roof span SP of over eighty feet (80 ft.) and preferably ranging from 85 ft.-100 ft. The truss system TS generally includes a plurality of truss members TM each having a top chord TC, a bottom chord BC, and a group of angular web members WM in between. Shown in FIG. 1B is a plan view of the attic space in which the truss members TM are spaced apart from one another on center by less than three feet (3 ft.) and more preferably spaced on two-foot (2 ft.) centers defining channels in between. In plan, the length of the ridge RP defines the axial length of the sloped attic space, for example, up to 150 ft.

The fire protection system 200 is a preferred five-branch system that provides a combination of different spray patterns to protect an attic space having a roof span of up to 100 ft. with a hydraulic demand that is less than previously known systems configured to protect an equal size attic space. The system 200 includes a plurality of sprinklers of a first type 205 in which each sprinkler preferably provides a uniform spray pattern radially about the sprinkler. The fire protection system 200 also includes a plurality of sprinklers of a second type 210 different than the first that provides a directional spray pattern in which a majority of the spray is directed substantially in a desired direction. Generally, two branch lines of the directional spray sprinklers of the second type are interleaved between three branch lines of radially uniform spray sprinklers. The branch lines are spaced parallel to one another over the roof span SP in a preferred manner to provide effective spray coverage with a hydraulic demand that is preferably less than 200 GPM and more preferably no more than 175 GPM. The system 200 is preferably hydraulically configured by providing firefighting fluid at preferred fluid flow rates and/or pressures to a number of design sprinklers that preferably range from 1 to no more than eight (1-8) design sprinklers, preferably no more than seven (7) design sprinklers, more preferably no more than six (6) design sprinklers and yet even more preferably no more than five (5) design sprinklers.

An exemplary embodiment of a sprinkler of the first type of sprinkler 205 is an upright sprinkler shown and described in technical data sheet publication, Form No. F-042517: "Attic Upright Specific Application Sprinkler VK697" (Aug. 23, 2018 Rev. 18.2) from The Viking Corp of Hastings, Mich. Generally, sprinklers of the first type 205 include a frame having a body with an inlet, an outlet and internal passageway extending between the inlet and the outlet along a central sprinkler axis to form the sprinkler orifice defining a preferred nominal K-factor of less than K 11.2 GPM/(PSI)$^{1/2}$ and is preferably K 5.6 GPM/(PSI)$^{1/2}$. The preferred frame includes a pair of frame arms to support and locate a fluid deflector at a fixed distance from the outlet. The deflector is bent or formed for installation in an upright orientation in which supplied firefighting fluid is discharged from the outlet to impact the deflector in an upward direction and distributed radially in a preferred uniform distribution about the sprinkler. A preferred deflector is generally a flat planar member that includes a substantially circular peripheral geometry with an arrangement of slots that extend radially from the deflector periphery toward the central axis of the deflector.

In the system 200, the sprinklers of the first type 205 preferably define three groups 205*a*, 205*b*, 205*c* based upon location and hydraulic characteristics. A first group 205*a* of sprinklers of the first type 205 is aligned below the ridge RP in which each sprinkler of the first type 205 is aligned along a channel and more preferably centered between two truss members TM. The sprinklers of the first type 205 are coupled to a first branch line BL1 disposed below and parallel to the ridge RP with the deflector of the sprinkler preferably within two feet of the ridge RP and more preferably within sixteen to twenty-four inches (16-24 in.) proximate the ridge RP. The sprinklers 205 are preferably spaced from one another along the branch line BL1 at a sprinkler-to-sprinkler spacing SS1 that ranges from seven to twelve feet (7-12 ft.) and is more preferably at a sprinkler-to-sprinkler spacing of eight feet (8 ft.). When provided with an appropriate operating flow of firefighting fluid, each sprinkler 205 and its spray pattern define a preferred maximum coverage area of one hundred ninety-two square feet (192 sq. ft.) to provide a preferred minimum fluid delivery density of no less than 0.1 GPM/sq. ft. In one preferred installation, the sprinklers of the first type 205 in the first group 205*a* provide a minimum fluid flow of 20 GPM at 13 psi. Accordingly, each sprinkler 205 provides a preferred fluid delivery density of about 0.1 GPM/sq. ft.

A second group 205*b* and a third group 205*c* of sprinklers of the first type 205 are separately aligned in rows between the ridge RP and an eave EV parallel to the ridge RP with the second and third groups 205*b*, 205*c* being spaced apart from one another preferably equidistantly about the ridge RP. The sprinklers of the first type 205 in each of the second and third groups 205*b*, 205*c* are aligned along a channel and more preferably centered between two truss members TM. In a preferred aspect, the sprinklers in each of the second and third groups 205*b*, 205*c* of the first type 205 are located within a channel that is spaced from a channel that includes a sprinkler of the first type 205 in the first group 205*a*. Accordingly, in a preferred installation and direction of roof span SP, the sprinklers of the second and third groups 205*b*, 205*c* are off-set OS from sprinklers of the first group 205*a*. The amount of off-set OS can range from two feet to six feet (2-6 ft.) and is preferably two feet when measured from sprinkler of a first type 205 to the next closest sprinkler 205 in a direction aligned with the peak RP. Alternatively, the sprinklers of the second and third groups 205*b*, 205*c* of the first type 205 are located within a channel that includes a sprinkler of the first type 205 in the first group 205*a*.

The second group 205*b* of sprinklers of the first type 205 is coupled to a second branch line BL2 disposed preferably downslope and parallel to the first branch line BL1 and the third group 205*c* of sprinklers of the first type 205 is coupled to a third branch line BL3 disposed preferably downslope and parallel to the first branch line BL1, opposite the second branch line BL2 about the ridge RP. The sprinklers in the second and third groups 205*b*, 205*c* are preferably spaced from one another along each of the second and third branch lines BL2, BL3 respectively, at a preferred sprinkler-to-sprinkler spacing SS2, SS3 that ranges from four to twelve feet (4-12 ft.), preferably ranges from seven to twelve feet (7-12 ft.), and is more preferably at a sprinkler-to-sprinkler spacing of twelve feet (12 ft.). The preferred installation of the sprinklers 205 of the second and third groups 205*b*, 205*c* locates the sprinklers proximate the eaves EV to provide for protection of the eaves EV at a preferred distance of within ten feet (10 ft.) upslope US from the eave EV and more preferably five feet (5 ft.) upslope US from the eave EV. Each of the sprinklers 205 in the second and third groups 205*b*, 205*c* is oriented with its sprinkler axis X-X perpendicular to the sloped roof deck RD such that the preferably planar deflector is parallel to the roof deck RD. Alternatively, the sprinkler can be oriented so that the planar deflector is parallel to the ceiling deck CD. The deflector is preferably located within the channels beneath the roof deck RD at a preferred distance that ranges from sixteen to twenty-two inches (16-22 in.) and additionally or alternatively, one to three inches (1-3 in.) below the bottom of the top chord TC of the truss members TM.

When provided with an appropriate operating flow of firefighting fluid, each sprinkler of the second and third groups 205*b*, 205*c* provide a radially uniform spray pattern with a portion in the direction of the eave EV with a preferred coverage area of ten feet-by-twelve feet (10 ft.×12 ft.). Accordingly, each sprinkler 205 of the second and third groups 205*b*, 205*c* and its spray pattern define a preferred coverage area of one hundred and twenty square feet (120 sq. ft.) to provide a preferred minimum fluid delivery density of no less than 0.1 GPM/sq. ft. In one preferred installation, the sprinklers are supplied with a minimum fluid flow of 15 GPM at 7 psi. Accordingly, each sprinkler 205 provides a preferred fluid delivery density of about 0.125 GPM/sq. ft.

Referring again to FIGS. 1A and 1B, the sprinklers of second type 210 are preferably divided into a two groups 210*a*, 210*b* that are respectively located downslope of the first group 205*a* of sprinklers of the first type 205 between the ridge RP and each of the second and third groups 205*b*, 205*c* of the sprinklers of the first type 205. Each of the first group 210*a* and second group 210*b* of sprinklers of the second type 210 is aligned in a row parallel to the ridge RP with the groups 210*a*, 210*b* spaced apart from one another preferably equidistantly about the ridge RP. Each sprinkler of the second type 210 is aligned along channel and more preferably centered between two truss members TM. Moreover, each sprinkler of the second type 210 is preferably located within a channel that is spaced from a channel that includes a sprinkler of the first type 205. Accordingly, in the preferred installation and direction of roof span SP, the sprinklers of the second type 210 are: (i) preferably off-set OS either from the upslope first type 205 sprinklers of the first group 205*a*; (ii) alternatively off-set OS from the first type of sprinklers 205 of the respective downslope second and third groups 205*a*, 205*b*; or (iii) off-set OS from the first type of sprinklers 205 of first, second and third groups 205*a*, 205*b*, 205*c*. The amount of off-set OS can range from two feet to six feet (2-6 ft.) and is preferably two feet when measured from sprinkler of a first type 205 to the next closest sprinkler 210 in a direction aligned with the peak ridge RP.

Each of the sprinklers of the second type 210 is oriented with its axis X-X perpendicular to the sloped roof deck RD such that its radially directed spray distribution, as described herein in greater detail, is directed in the downward slope direction toward the eaves EV. The deflector 100 is preferably located within the channels beneath the roof deck RD at a preferred distance that ranges from sixteen to twenty-two inches (16-22 in.) and additionally or alternatively, one to three inches (1-3 in.) below the bottom of the top chord TC of the truss members TM.

The first group 210*a* of sprinklers of the second type 210 is coupled to a fourth branch line BL4 disposed preferably downslope and parallel to the first branch line BL1 and the second group 210*b* of sprinklers of the second type 210 is coupled to a fifth branch line BL5 disposed preferably downslope and parallel to the first branch line BL1 opposite the opposite the fourth branch line BL4 about the ridge RP. The second type 210 of sprinklers in each of the first and second groups 210*a*, 210*b* are preferably spaced from one another along each of the fourth and fifth branch lines BL4, BL5 at respective preferred sprinkler-to-sprinkler spacings SS4, SS5 that ranges from four to twelve feet (4-12 ft.), preferably ranges from seven to twelve feet (7-12 ft.), and is more preferably at a sprinkler-to-sprinkler spacing of eight feet (8 ft.).

With reference to FIG. 1B, the directional spray sprinklers of the second type 210 are preferably located twelve to thirty feet (12-30 ft.) downslope DS of the first group 205*a* uniform distribution sprinklers of the first type 205 and more preferably, fifteen to twenty-six feet (15-26 ft.) downslope, even more preferably at a minimum fifteen to sixteen feet (15-16 ft.) and yet even more preferably at a minimum fifteen feet (15 ft.) downslope of the first group 205*a* of uniform distribution sprinklers of the first type 205. With the preferred downslope spacing between the first and second type of sprinklers 205, 210, the system 200 with the preferred five branch system arrangement can provide for the preferred maximum roof span of fire protection PSP of over eighty feet (80 ft.) preferably up to one hundred feet (100 ft.) when the sprinklers of the first type 205 are supplied with firefighting fluid at the preferred minimum flow of 15 GPM for the sprinklers 205 at the ridge and at the minimum flow of 20 GPM for the sprinklers at the eaves and the sprinklers of the second type 210 are supplied with firefighting fluid at a minimum flow of at least 23 GPM.

When provided with an appropriate operating flow of firefighting fluid, each sprinkler of the second type 210 is capable of providing a spray pattern with a forward horizontal throw in the direction of the eave EV of twenty-eight feet (28 ft.), a rearward throw in the direction of the ridge RP of four feet (4 ft.) and a maximum lateral throw about the forward discharge of about 8 ft. Preferably, the sprinkler of the second type 210 and its directed spray pattern define a preferred maximum coverage area of two hundred twenty-four square feet (224 sq. ft.) to provide a preferred minimum fluid delivery density of no less than 0.1 GPM/sq. ft. In one preferred installation, the sprinklers of the first type are supplied with a minimum fluid flow of 23 GPM at 17 psi. Accordingly, each sprinkler of the second type 210 provides a preferred fluid delivery density of about 0.1 GPM/sq. ft.

Individually and cumulatively, the first and second type of sprinklers 205, 210 their respective spray patterns and the fluid distribution densities define a preferred maximum roof span of protection PSP which is preferably eighty feet or more and more preferably ranges from eighty-five feet to one hundred feet (85-100 ft.) and in various embodiments of the preferred system, provide a maximum roof span of protection of one hundred feet (100 ft.). Additionally, the first and second type of sprinklers 205, 210, their spray patterns and the fluid distribution densities individually and cumulatively can provide for protection over the range of roof slopes SL to define a roof slope of protection SLP that preferably ranges from 2½:12 to 12:12 with the roof slope of protection SLP ranging therebetween including 4:12 to 12:12, 4:12 to 6:12 and more preferably 2½:12 to 6:12.

The system 200 can be configured as a wet system in which the branch lines are filled with water to supply a starting or operating pressure of fluid at the inlet of the sprinkler in the unactuated state of the sprinkler system 200. Alternatively, the system 200 can be configured as a dry system in which the branch lines are filled with air and fluid delivery to the sprinklers is controlled by a fluid control valve. Due to the inherent delay in delivery of fluid to the sprinklers in a dry system, the hydraulic demand of the dry system is preferably greater than that of a wet system for protection of the same space. The hydraulic demand of the attic system 200 is preferably defined by a total fluid flow to be provided to a preferred design area defined by a preferred number of design sprinklers of the system when supplied with a designated fluid pressure.

The system 200 is preferably hydraulically configured to provide the preferred fluid flow to a number of design sprinklers which preferably range from 1 to no more than eight (1-8) design sprinklers. The system 200, when configured as a wet system, is preferably hydraulically configured with a system hydraulic demand that is less than 200 GPM, preferably ranging from 100 GPM to less than 175

GPM and in preferred embodiments 100 GPM. A preferred hydraulic demand of the system is based upon a design area defined by no more than seven design sprinklers each provided with a preferred minimum flow of firefighting fluid. In one preferred embodiment, the seven design sprinklers include at least one of: (i) one to no more than five adjacent design sprinklers of the first type 205 in the first group 205*a* each having a minimum flow at the preferred 20 GPM preferably supplied by a fluid pressure of 13 psi.; and (ii) one to no more than two adjacent design sprinklers of the first type 205 in one of the second and third groups 205*b*, 205*c* each having minimum flow at the preferred 15 GPM preferably supplied by a fluid pressure of 7 psi. Accordingly, one preferred set of hydraulic criteria of the system 200 is based upon a hydraulic demand defined by a design area of no more than seven (7) design sprinklers that includes five (5) sprinklers in the first group 205*a* each with a minimum flow of 20 GPM; and/or two (2) sprinklers in the second group 205*b* each with a minimum flow of 15 GPM to define a maximum total hydraulic demand of 130 GPM. Alternatively, the design area can be defined by five design sprinklers preferably being the five (5) adjacent sprinklers in the first group 205*a* each with a minimum flow of 20 GPM to define a total hydraulic demand of 100 GPM. In yet another alternate embodiment of the design criteria, the preferred design area of five design sprinklers can be defined by at least three adjacent sprinklers of the first group of the first type 205*a*, with each having a minimum flow of 20 GPM and two adjacent sprinklers of the second type 210 in either of the first or second group 210*a*, 210*b* each having a minimum flow of 23 GPM downslope of the three adjacent sprinklers of the first group 205*a* to define a total hydraulic demand of 106 GPM.

Alternatively, a preferred wet system 200 can be hydraulically configured to satisfy the greatest hydraulic demand as defined from the following criteria: one to no more than five adjacent design sprinklers of the second type 210 in one of the first and second group 210*a*, 210*b* each having minimum flow at the preferred 23 GPM with a supplied fluid pressure of 17 psi. and one to no more than two adjacent design sprinklers of the first type 205 in one of the second and third groups 205*b*, 205*c* at 15 GPM and 7 psi. downslope of the 1-5 design sprinklers of the second type 210. Thus, in another in preferred hydraulic criteria including seven (7) design sprinklers consisting of five (5) sprinklers of the second type 210 in the first group 210*a* at 23 GPM and 17 psi, and two (2) sprinklers of the first type 205 in the second group 205*b* at 15 GPM and 7 psi., the total hydraulic demand is 145 GPM.

When configured as a dry system, the system 200 is preferably hydraulically configured to provide the preferred fluid flow to no more than eight (8) design sprinklers. The system 200, when configured as a dry system, is preferably hydraulically configured with a system hydraulic demand that is less than 200 GPM, preferably ranging from 100 GPM to less than 175 GPM and in preferred embodiments 120 GPM. In one preferred embodiment, the eight (8) design sprinklers include at least one of: (i) one to no more than six adjacent design sprinklers of the first type 205 in the first group 205*a* each having a minimum flow at the preferred 20 GPM with a preferably supplied fluid pressure of 13 psi.; and (ii) one to no more than two adjacent design sprinklers of the first type 205 in one of the second and third groups 205*b*, 205*c* each having minimum flow at the preferred 15 GPM with a preferably supplied fluid pressure of 7 psi. Accordingly, in one set of preferred hydraulic criteria of the system 200 is based upon a hydraulic demand defined by a design area of no more than eight (8) design sprinklers that includes six (6) sprinklers in the first group 205*a* each with a minimum flow of 20 GPM; and two (2) sprinklers in the second group 205*b* each with a minimum flow of 15 GPM to define a maximum total hydraulic demand of 150 GPM. Alternatively, the design area for the dry system can be defined by six design sprinklers preferably being the six (6) adjacent sprinklers in the first group 205*a* each with a minimum flow of 20 GPM to define a total hydraulic demand of 100 GPM. In yet another alternate embodiment of the design criteria, the preferred design area of six design sprinklers can be defined by at least four (4) adjacent sprinklers of the first group of the first type 205*a*, with each having a minimum flow of 20 GPM and two adjacent sprinklers of the second type 210 in either of the first or second group 210*a*, 210*b* each having a minimum flow of 23 GPM downslope of the three adjacent sprinklers of the first group 205*a* to define a total hydraulic demand of 126 GPM.

Alternatively, a preferred dry system 200 can be hydraulically configured to satisfy the greatest hydraulic demand as defined from the following criteria: one to no more than six adjacent design sprinklers of the second type 210 in one of the first and second group 210*a*, 210*b* each having minimum flow at the preferred 23 GPM with a supplied fluid pressure of 17 psi. and one to no more than two adjacent design sprinklers of the first type 205 in one of the second and third groups 205*b*, 205*c* at 15 GPM and 7 psi. downslope of the 1-5 design sprinklers of the second type 210. Thus, in another preferred hydraulic criteria including eight (8) design sprinklers consisting of six (6) sprinklers of the second type in the first group 210*a* at 23 GPM and 17 psi, and two (2) sprinklers of the first type 205 in the second group 205*b* at 15 GPM and 7 psi., the total hydraulic demand is 168 GPM.

The preferred systems provide for a preferred method of attic fire protection for large roof spans, e.g., over eighty feet, with a hydraulic demand lower than those under prior known commercial systems. Given the various spray patterns and sprinkler spacings described, a preferred method of fire protection of an attic space includes obtaining sprinklers with a directional fluid distribution; and providing the directional spray sprinklers for interleaving between groups of sprinklers located at the ridge peak and at the eave having a radially uniform fluid distribution to protect the attic space with a total hydraulic demand of no more than 175 GPM. Obtaining a preferred sprinkler can include any one of manufacturing or acquiring the preferred sprinklers; and providing can include any one of selling, specifying, or supplying the preferred sprinklers for installation in a preferred manner as described herein.

Figure 2A:
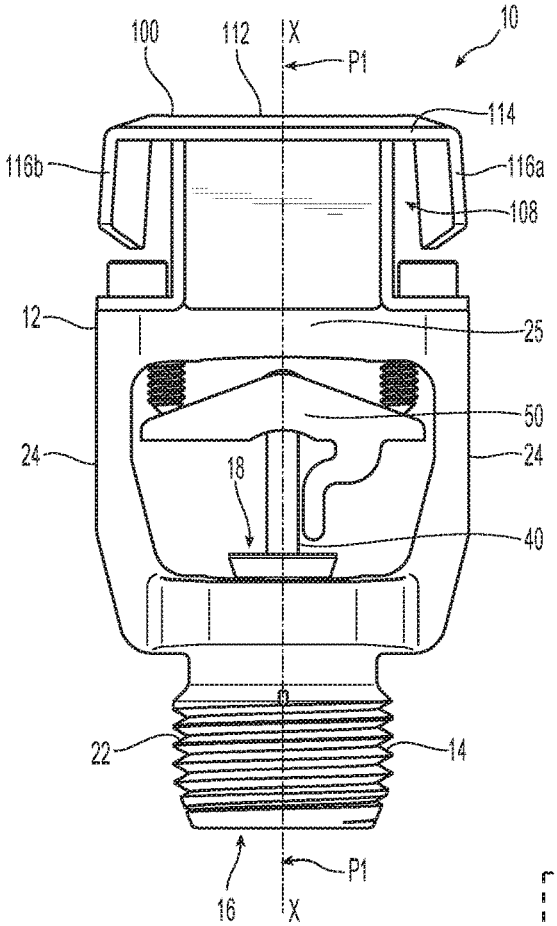
FIG. 2A is a front view of a preferred embodiment of a directional spray sprinkler.
Figure 2B:
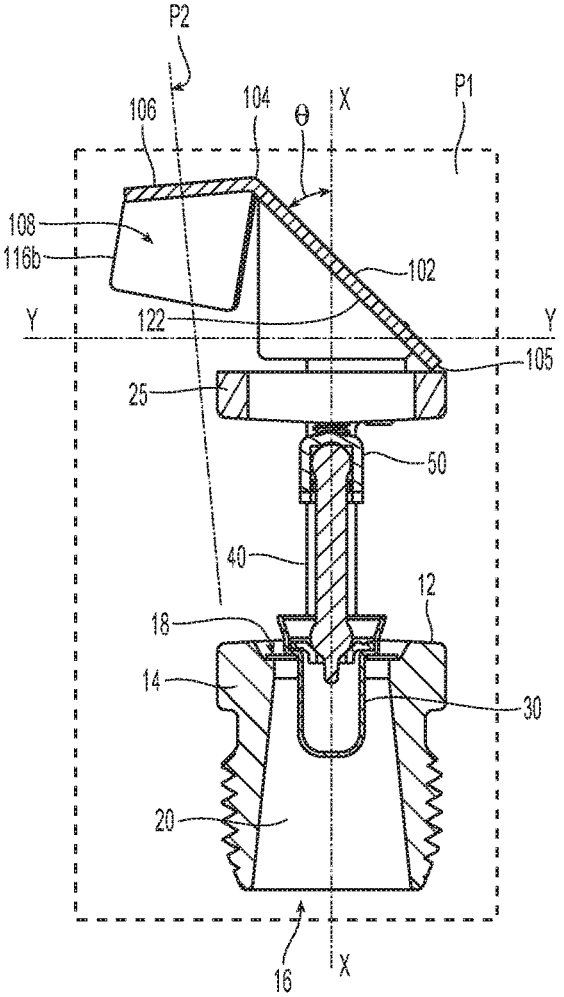
FIG. 2B is a cross-sectional view of the sprinkler of FIG. 2A.

Shown in FIGS. 2A-2B is a preferred embodiment of a fire protection sprinkler 10 for providing the preferred directional spray in the sprinklers of the second type 210 of system 200. The preferred sprinkler 10 includes a frame 12 including a body 14 defining an inlet 16, an outlet 18 with a passageway 20 extending between the inlet 16 and the outlet 18 along a sprinkler axis X-X to define an orifice. The body is configured for coupling the sprinkler 10 to a fluid supply pipe SP. For example, the body 14 can include an external pipe thread 22 for coupling to a female fitting having a complementary thread for engagement with the sprinkler 10. The preferred frame 12 includes a pair of frame arms 24 to support and locate a deflector 100 at a fixed distance from the outlet 18. The pair of frame arms 24 extend from the body 14 at diametrically opposed sides of the outlet 18 with a deflector boss 25 that extends across the ends of the frame arms 24. The boss 25 is preferably an annular formation centered along the sprinkler axis X-X and coaxially aligned with the outlet at a fixed distance from the outlet 18. The deflector 100 is affixed and preferably mounted to the boss 25 to locate the deflector 100 at the fixed distance from the outlet. The deflector 100 is illustratively shown bent or formed for installation in an upright orientation in which supplied firefighting fluid is discharged from the outlet 18 to impact the deflector 100 in an upward direction.

The deflector 100 is preferably affixed to the sprinkler frame 12 and spaced at a fixed distance from the outlet 18 for deflecting fluid in a direction of a radial axis Y-Y that extends perpendicular to the sprinkler axis X-X. The deflector 100 includes a base portion 102 mounted to the sprinkler frame having a leading edge 104 with a flap 106 extending angularly from the leading edge 104 of the base 102. The flap 106 forms a preferred discharge channel 108 that extends in the direction of the radial axis Y-Y with the channel being preferably symmetrical about a bisecting plane P1 defined by the intersection of the sprinkler axis X-X and the radial axis Y-Y.

Figure 3A:
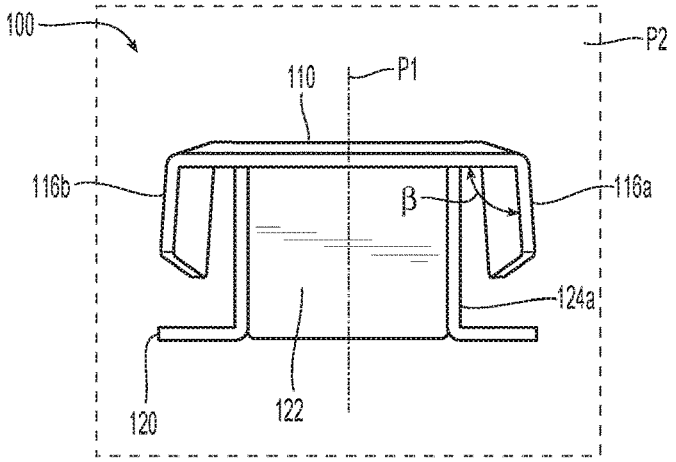
FIGS. 3A-3C are various views of a preferred deflector for use in the directional spray sprinkler of FIG. 1.
Figure 3B:
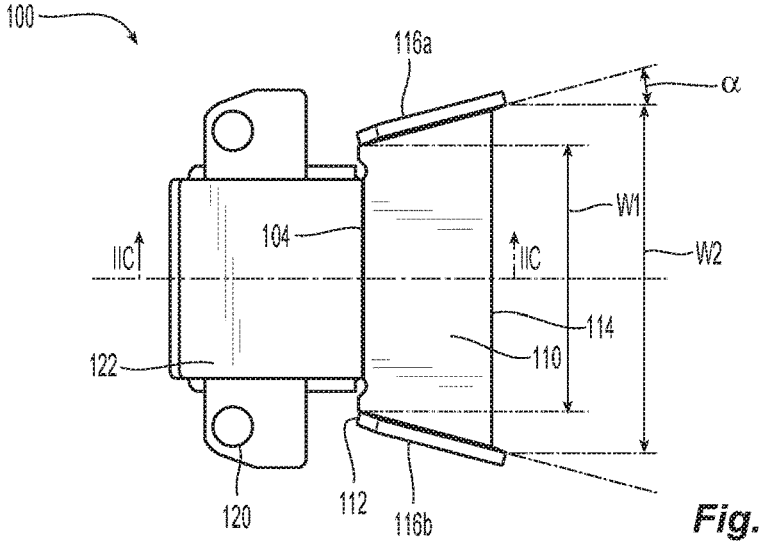
Figure 3C:
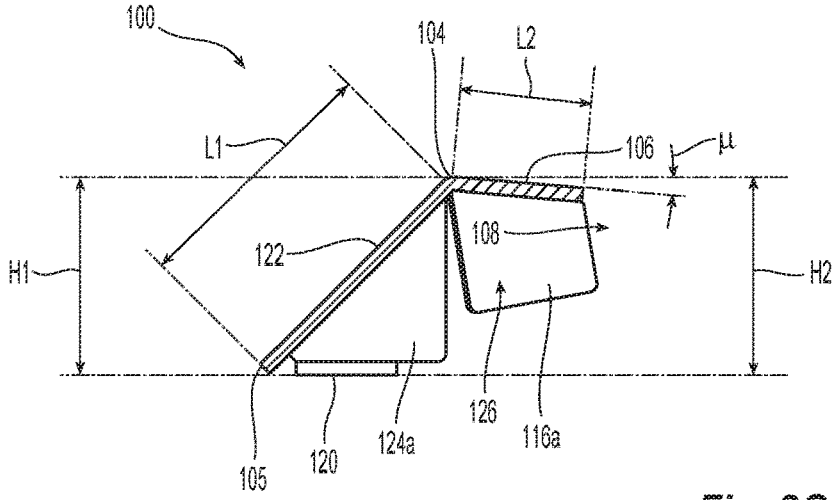

As shown in FIGS. 3A-3C, the preferred flap 106 includes a central canopy portion 110 that intersects the bisecting plane P1 with a first end 112 contiguous with the leading edge 104 of the base 102 and a second terminal end 114 forming the terminal end of the discharge channel 108 of the deflector 100. The flap 106 includes a pair of sidewalls 116*a*, 116*b* disposed about the central canopy portion 110. In the preferred deflector 100, each of the sidewalls 116*a*, 116*b* is angled with respect to the bisecting plane P1 to define an acute first included angle $\alpha$ such that the discharge channel 108 broadens or widens in the direction from the first end 112 to the second terminal end 114 of the flap 106. Additionally, or alternatively, lateral edges of the canopy portion 110 extend between the first and second end 112, 114 at the preferred angle $\alpha$. Accordingly, in a preferred embodiment of the canopy portion 110, the second terminal end 114 has a width W2 that is greater than the width W1 of the first end 112 such that canopy portion 110 is substantially trapezoidal in shape. The second and first ends 114, 112 of the canopy portion 110 defines a preferred ratio W2:W1 that preferably ranges from 1.33:1 to 1.67:1. In a preferred embodiment of the canopy portion 110, the width W2 at the second terminal end 114 is about one inch (1 in.) and the width W1 of the canopy portion at the first end 112 is about 0.75 inch. The first acute preferably included angle $\alpha$ preferably ranges from ten to forty-five degrees (10°-45°), more preferably ranges from ten to thirty degrees (10°-30°), even more preferably ranges from ten to thirty degrees (10°-20°) and yet even more preferably is fifteen degrees (15°). Therefore, in preferred embodiments of the deflector flap 106, the formed discharge channel 108 is also preferably trapezoidal in shape.

Each of the sidewalls 116*a*, 116*b* also define a second included angle $\beta$ with respect to the canopy portion 110 in a plane P2 that is disposed perpendicular to the first plane P1, as seen for example in FIGS. 1B and 2A. In one preferred aspect, each of the sidewalls define a ninety degree (90°) second included angle $\beta$ with the canopy portion. Alternatively, the sidewall can define an obtuse included angle $\beta$ that is preferably less than 150 degrees (150°) and can more preferably be about 130 degrees (130°) or even more preferably 112 degrees (112°).

The flap portion 106 and its various features can define other dimensional relationships to the base portion 102 that can further define the spray characteristics of the sprinkler 10. The base portion 102 includes a mounting portion 120 for affixing the deflector 100 to the frame 12. Preferably, the mounting portion 120 is preferably configured as one or more flanges through which a fastener such as, for example, an Allen or hex-head screw is used to affix the deflector 100 to the frame 12. The base portion 102 further includes a central deflecting plate 122 and a pair of lateral walls 124*a*, 124*b* disposed about the deflecting plate 122 to form an intermediate flow channel 126 that extends from the frame 12 to the discharge channel 108. Preferably, the distance between the sidewalls 116*a*, 116*b* of the flap 106 is greater than the distance between the lateral walls 124*a*, 124*b* of the base 102 such that the base 102 portion is narrower than the flap portion 106.

The central deflecting plate 122 includes the leading edge 104 that is proximate and preferably contiguous with the flap 106. Opposite the leading edge 104, the deflecting plate 122 includes a trailing edge 105 proximate and preferably contiguous with the mounting portion 120 and the lateral walls 124*a*, 124*b*. The trailing edge 105 and the leading edge 104 of the base 102 are axially spaced apart from one another in the direction of the central axis X-X to define a preferred maximum deflector height H1. To form the intermediate channel 126, each of the lateral walls 124*a*, 124*b*, is preferably formed and shaped so as to extend axially from the trailing edge 105 to the deflector plate 122 over the total length L1 of the deflector plate 122. Accordingly, the intermediate channel 126 preferably has a triangular volume. The deflecting plate 122 preferably intersects the sprinkler axis X-X to define a skew angle $\theta$ therebetween, as seen in FIG. 2B, that preferably ranges from thirty to sixty degrees (30°-60°) and is more preferably forty-five degrees (45°). Accordingly, water discharged from the outlet 18 of the frame 12 impacts the angled deflector plate 122 and with a majority of the fluid being directed toward the discharge channel 108 of the flap 106. The flap portion is preferably angled with respect to a plane parallel to the Y-Y axis at an angle $\mu$ at less than thirty degrees (30°) to less than fifteen degrees (15°) and is more preferably five degrees (5°). Accordingly, in a preferred embodiment the canopy portion 110 of the flap 106 and the deflector plate 122 define a preferred included angle in between of about one hundred thirty degrees (130°).

Referring to FIG. 3C, the axial depth or height H2 of the flap portion 106 and its discharge channel 108 preferably varies in the axial direction of the sprinkler axis X-X from the canopy portion 110 to a peripheral edge of the sidewalls 116*a*, 116*b* over the total length L2 of the canopy portion 110. The maximum height H2Max of the flap portion is preferably less than the maximum height H1 of the base portion 102 and define a preferred ratio of base height-to-flap ratio (H1:H2Max) ranging from 1.3:1 to 2:1. The length L2 of the canopy portion 110 is preferably less than the length L1 of the deflecting portion 122; and in another preferred aspect, the ratio of the lengths L1:L2 ranges preferably from 1.3:1 to 2:1. In a preferred embodiment of the deflector 100, the length L1 of the deflecting portion 122 is about one inch (1 in.) and the length L2 of the canopy portion 110 is about 0.5 inch.

FIG. 2B shows the cross-sectional view of the frame body 14 and its internal passageway 20. Fluid supplied to the sprinkler inlet 16 flows through the internal passageway 20 and is discharged from the outlet 18 to impact the deflector 100 to address a fire. The internal passageway 20 preferably tapers narrowly from the inlet 16 to the outlet 18. The discharge characteristics from the sprinkler body 12 and its outlet orifice define a nominal K-factor that is preferably less than K11 GPM/$(PSI)^{1/2}$ and is preferably a K 5.6 GPM/

$(PSI)^{1/2}$. Alternatively, the sprinkler body 14 can define a nominal K-factor of any one of 8.0 GPM/$(PSI)^{1/2}$; 4.2 GPM/$(PSI)^{1/2}$ or smaller. Further in the alternative, the sprinkler body 14 can define a nominal K-factor larger than that of a nominal K-factor 11.2 GPM/$(PSI)^{1/2}$.

Preferred embodiments of the sprinkler 10, are preferably configured as automatic sprinklers such that fluid discharge from the connected sprinkler 10 and its outlet 18 is controlled by a seal assembly 30 that is disposed within the passageway 20 proximate the outlet 18 to occlude the outlet. The seal assembly 30 is supported within outlet 18 of the sprinkler body 14 by a thermally responsive element or trigger 40 aligned along the sprinkler axis X-X between the sealing assembly 30 and a loading assembly 50. The thermally responsive element 40 is preferably embodied as a thermally responsive frangible glass bulb but can be alternatively embodied as a thermally responsive mechanical or electrically actuated assembly provided the assembly can seat and unseat the seal assembly 30 in respective unactuated and actuated states of the sprinkler. In the presence of a sufficient level of heat, the thermally responsive element 40 operates or triggers to release the sealing assembly 30 and permit the supplied fluid to discharge from the outlet 18 to impact the deflector 100 and address a fire.

When provided with a supply of firefighting fluid at a fluid pressure of 17 psi to provide the preferred flow rate of 23 GPM as previously described, the preferred directional spray sprinkler 10 directs fluid forward of the deflector 100 to a horizontal throw distance of up to twenty-eight feet (28 ft.). Laterally of the direction of throw, the sprinkler discharges over a width of eight feet (8 ft.), so as to define a preferred 8 ft.×28 ft. coverage area. Moreover, the sprinkler 10 directs fluid rearward of the deflector 100 to a rearward distance of no more than five feet (5 ft.) and more preferably up to four feet (4 ft.). Accordingly, a majority of the spray distribution is forward of the sprinkler 10. The throw distance of the sprinkler is advantageous in protecting the low clearance areas of the large roof span attic spaces in a manner as described with respect to the system 200.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A fire protection system for a sloped attic space defined by a pair of sloped roof decks defining a ridge in between with a ceiling base extending between and below the sloping roof decks to define a pair of eaves equally spaced about the ridge to define a maximum roof span, the system comprising:

a plurality of sprinklers of a first sprinkler, each sprinkler of the first type defined by a uniform spray pattern radially about the sprinkler of the first sprinkler, each sprinkler of the first type having a frame defining an inlet, an outlet with a passageway extending between the inlet and the outlet along a sprinkler axis and a deflector affixed to the sprinkler frame at a fixed distance from the outlet to generate the uniform spray pattern, the plurality of sprinklers of the first sprinkler defining three group locations consisting of:

a first group aligned below the ridge;

a second group being aligned in a row between the ridge and one of the eaves parallel to the ridge; and a third group being aligned in a row between the ridge and the other eave parallel to the ridge with the second and third group of the sprinklers of the first type being spaced apart from one another equidistantly about the ridge; and a plurality of sprinklers of a second sprinkler different than the first sprinkler, each sprinkler of the second sprinkler defined by a directional spray pattern in which a majority of the directional spray pattern is directed in one direction with respect to the sprinkler of the second sprinkler, each sprinkler of the second sprinkler having a frame defining an inlet, an outlet with a passageway extending between the inlet and the outlet along a sprinkler axis, and a deflector affixed to the sprinkler frame at a fixed distance from the outlet to direct the majority of the spray pattern in the one direction, the plurality of sprinklers of the second sprinkler defining two group locations consisting of:

a first group of sprinklers of the second sprinkler being aligned in a row between the ridge and the second group of sprinklers of the first sprinkler parallel to the ridge; and a second group of sprinklers of the second sprinkler being aligned in a row between the ridge and the third group of sprinklers of the first sprinkler parallel to the ridge, the first and second group of the sprinklers of the second type being spaced apart from one another equidistantly about the ridge;

the first and second sprinkler types each providing a fluid density to define a maximum roof span of protection of over eighty feet to no more than one hundred feet (100 ft.) with a hydraulic demand of the system being less than two hundred gallons per minute (<200 GPM).

2. The system of claim 1, wherein the sprinklers of the first sprinkler and the sprinklers of the second sprinkler are off-set from one another in the downslope direction from the ridge to one of the eaves.

3. The system of claim 2, wherein the first group of sprinklers of the second sprinkler are spaced apart from one another at a sprinkler-to-sprinkler spacing of eight feet (8 ft.), wherein the second group of sprinklers of the second sprinkler are spaced apart from one another at a sprinkler-to-sprinkler spacing of eight feet (8 ft.).

4. The system of claim 3, wherein each group of sprinklers of the first sprinkler are spaced apart from one another at a sprinkler-to-sprinkler spacing of eight feet (8 ft.).

5. The system of claim 4, wherein each of the first and second group of sprinklers of the second sprinkler are downslope by about fifteen feet (15 ft.) from the ridge.

6. The system of claim 1, wherein the first group of sprinklers of the first sprinkler are spaced apart from one another at a sprinkler-to-sprinkler spacing of eight feet (8 ft.), wherein the second and third group of sprinklers of the first sprinkler are spaced apart from one another at a sprinkler-to-sprinkler spacing of twelve feet (12 ft.).

7. The system of claim 6, wherein the sprinklers of the second and third groups of the first sprinkler are located upslope of the eave within ten feet (10 ft.).

8. The system of claim 7, wherein the sprinklers of the second and third groups of the first sprinkler are located upslope of the eave within five feet (5 ft.).

9. The system of claim 1, wherein the system is a wet system and the hydraulic demand of the system ranges from 100 GPM to less than 175 GPM based upon a design area defined by no more than seven design sprinklers.

10. The system of claim 9, wherein hydraulic demand of the system is 100 GPM.

11. The system of claim 9, wherein the seven design sprinklers are defined by at least one of: (i) five adjacent sprinklers of the first group of sprinklers of the first sprinkler each having a minimum flow at 20 GPM; and (ii) no more than two sprinklers of the first sprinkler downslope of the five sprinklers each having a minimum flow of 15 GPM.

12. The system of claim 9, wherein the design area is defined by five design sprinklers, the five design sprinklers being the five adjacent sprinklers of the first group of the first sprinkler each having a minimum flow of 20 GPM.

13. The system of claim 9, wherein the design sprinklers include at least three adjacent sprinklers of the first group of the first sprinkler each having a minimum flow of 20 GPM and two adjacent sprinklers of the second sprinkler each having a minimum flow of 23 GPM downslope of the three adjacent sprinklers of the first group of the first sprinkler.

14. The system of claim 9, wherein the seven design sprinklers are defined by at least one of: (i) five adjacent sprinklers each having a minimum flow of the second sprinkler each having a minimum flow of 23 GPM; and (ii) no more than two sprinklers of the first sprinkler each having a minimum flow of 15 GPM and downslope of the five adjacent sprinklers of the second sprinkler.

15. The system of claim 1, wherein the system is a dry system and the hydraulic demand of the system ranges from 100 GPM to less than 175 GPM based upon a design area based upon a design area defined by no more than eight design sprinklers.

16. The system of claim 15, wherein the hydraulic demand of the system is 120 GPM.

17. The system of claim 15, wherein the eight design sprinklers are defined by at least one of: (i) six adjacent sprinklers of the first group of sprinklers of the first sprinkler flowing at 20 GPM; and (ii) no more than two sprinklers of the first sprinkler downslope of the six sprinklers and flowing at 15 GPM.

18. The system of claim 15, wherein the design area is defined by six design sprinklers, the six design sprinklers being the six adjacent sprinklers of the first group of the first sprinkler each having a minimum flow of 20 GPM.

19. The system of claim 15, wherein the eight design sprinklers include at least four adjacent sprinklers of the first group of the first sprinkler each having a minimum flow of 20 GPM and two adjacent sprinklers of the second sprinkler each having a minimum flow of 23 GPM downslope of the three adjacent sprinklers of the first group of the first sprinkler.

20. The system of claim 15, wherein the eight design sprinklers are defined by at least one of: six adjacent sprinklers of the second sprinkler flowing at 23 GPM; and (ii) no more than two sprinklers of the first sprinkler having a minimum flow of 15 GPM and downslope of the six adjacent sprinklers of the second sprinkler.

21. The system of claim 1, wherein the deflector of the sprinklers of the second sprinkler have a base and a flap extending angularly from the base, the flap including a trapezoidal canopy portion and a pair of sidewalls disposed about the central canopy portion, wherein the deflector of the sprinklers of the first sprinkler are planar with a circular peripheral geometry.

22. The system of claim 1, wherein the plurality of sprinklers define a roof slope of protection that ranges from 2½:12 to 12:12.

23. The system of claim 22, wherein the roof slope of protection ranges from 2½:12 to 6:12.

24. The system of claim 1, wherein the hydraulic demand of the system is no more than 175 GPM.

25. A method of fire protection of a large roof span attic space defined by a ridge peak and eave regions disposed about the ridge peak, the method comprising:

obtaining a plurality of directional spray sprinklers; and providing the plurality of directional spray sprinklers as the second sprinkler for installation in the fire protection system of claim 1.

26. The method of claim 25, wherein the providing the plurality of directional spray sprinklers comprises providing each of the plurality of directional spray sprinklers as a sprinkler comprising:

a frame including a body defining an inlet, an outlet with a passageway extending between the inlet and the outlet along a sprinkler axis to define an orifice; and a deflector affixed to the frame at a fixed distance from the outlet for deflecting fluid in a direction of a radial axis that extends perpendicular to the sprinkler axis, the deflector including a base mounted to the frame, the base including a deflector plate having a leading edge with a flap extending angularly from the leading edge of the deflector plate, the flap forming a discharge channel extending in the radial direction with the channel being symmetrical about a bisecting plane defined by the intersection of the sprinkler axis and the radial axis, wherein the flap consisting of a trapezoidal canopy portion intersecting the bisecting plane, the trapezoidal canopy portion having a first end contiguous the leading edge of the deflector plate and a second terminal end, and a pair of sidewalls disposed about the trapezoidal canopy portion.

27. A sprinkler for a fire protection system as recited in claim 1, the sprinkler being the second sprinkler of the fire protection system, the sprinkler, comprising:

a frame including a body defining an inlet, an outlet with a passageway extending between the inlet and the outlet along a sprinkler axis to define an orifice; and a deflector affixed to the frame at a fixed distance from the outlet for deflecting fluid in a direction of a radial axis that extends perpendicular to the sprinkler axis, the deflector including a base mounted to the frame, the base including a deflector plate having a leading edge with a flap extending angularly from the leading edge of the deflector plate, the flap forming a discharge channel extending in the radial direction with the channel being symmetrical about a bisecting plane defined by the intersection of the sprinkler axis and the radial axis, wherein the flap consisting of a trapezoidal canopy portion intersecting the bisecting plane, the trapezoidal canopy portion having a first end contiguous the leading edge of the deflector plate and a second terminal end, and a pair of sidewalls disposed about the trapezoidal canopy portion.

28. The sprinkler of claim 27, wherein each of the pair of sidewalls define a ninety degree angle with the trapezoidal canopy portion, wherein the base includes a deflecting plate and a pair of lateral walls disposed about the deflecting plate, the distance between the pair of sidewalls of the flap being greater than the distance between the pair of lateral walls of the base, wherein the deflecting plate intersects the sprinkler axis to define a skew angle therebetween ranging from thirty to sixty degrees, wherein the deflecting plate defines a first length and the trapezoidal canopy portion defines a second length, the first length being greater than the second length; and wherein the leading edge of the deflecting plate is smaller than each length of the first end and second terminal end of the trapezoidal canopy portion.

* * * * *